US007612282B1

(12) United States Patent
Lawing

(10) Patent No.: US 7,612,282 B1
(45) Date of Patent: Nov. 3, 2009

(54) MUSICAL INSTRUMENT PICKUP

(76) Inventor: Andrew Scott Lawing, 416 Paper Mill Rd., Newark, DE (US) 19711

( * ) Notice: Subject to any disclaimer, the term of this patent is extended or adjusted under 35 U.S.C. 154(b) by 0 days.

(21) Appl. No.: 12/104,121

(22) Filed: Apr. 16, 2008

Related U.S. Application Data

(60) Provisional application No. 60/923,607, filed on Apr. 16, 2007, provisional application No. 60/995,610, filed on Sep. 26, 2007.

(51) Int. Cl.
*G10H 3/18* (2006.01)

(52) U.S. Cl. ..... 84/726; 84/725; 84/728

(58) Field of Classification Search ..... 84/723, 84/725–728, 743
See application file for complete search history.

(56) References Cited

U.S. PATENT DOCUMENTS

| | | | | | |
|---|---|---|---|---|---|
| 2,455,575 | A | | 12/1948 | Fender et al. | |
| 2,896,491 | A | | 7/1959 | Lover | |
| 2,933,967 | A | | 4/1960 | Riscol | |
| 3,035,472 | A | * | 5/1962 | Freeman | 84/726 |
| 3,249,677 | A | * | 5/1966 | Burns et al. | 84/726 |
| 3,585,424 | A | * | 6/1971 | Neel | 310/25 |
| 4,096,780 | A | | 6/1978 | Dawson | |
| 4,145,944 | A | * | 3/1979 | Helpinstill, II | 84/726 |
| 4,348,930 | A | * | 9/1982 | Chobanian et al. | 84/726 |
| 4,372,187 | A | | 2/1983 | Berg | |
| 4,499,809 | A | * | 2/1985 | Clevinger | 84/726 |
| 4,534,258 | A | * | 8/1985 | Anderson | 84/728 |
| 4,535,668 | A | * | 8/1985 | Schaller | 84/727 |
| 4,581,974 | A | * | 4/1986 | Fender | 84/725 |
| 4,624,172 | A | * | 11/1986 | McDougall | 84/726 |
| 5,111,728 | A | * | 5/1992 | Blucher et al. | 84/726 |
| 5,148,733 | A | * | 9/1992 | Beller | 84/726 |
| 5,292,998 | A | * | 3/1994 | Knapp | 84/726 |
| 5,335,576 | A | * | 8/1994 | Hayashi | 84/727 |
| 5,336,845 | A | * | 8/1994 | Lace, Sr. | 84/726 |
| 5,389,731 | A | * | 2/1995 | Lace | 84/726 |
| 5,523,526 | A | * | 6/1996 | Shattil | 84/728 |
| 5,530,199 | A | * | 6/1996 | Blucher | 84/728 |
| 5,567,903 | A | * | 10/1996 | Coopersmith et al. | 84/723 |
| 5,610,357 | A | * | 3/1997 | Frank-Braun | 84/726 |
| 6,043,422 | A | * | 3/2000 | Chapman | 84/723 |
| 6,162,984 | A | * | 12/2000 | Engard | 84/743 |
| 6,476,309 | B2 | | 11/2002 | Gaglio | |
| 6,846,981 | B2 | | 1/2005 | Devers | |
| 6,849,792 | B2 | * | 2/2005 | Yeakel | 84/298 |
| 6,992,243 | B2 | * | 1/2006 | Small | 84/267 |
| 7,285,714 | B2 | * | 10/2007 | Juszkiewicz et al. | 84/726 |
| 7,375,276 | B2 | * | 5/2008 | Kanayama et al. | 84/723 |
| 2002/0069749 | A1 | * | 6/2002 | Hoover et al. | 84/738 |
| 2003/0051596 | A1 | * | 3/2003 | Gustafsson | 84/723 |
| 2005/0076775 | A1 | * | 4/2005 | Small | 84/743 |
| 2005/0126377 | A1 | * | 6/2005 | Kanayama et al. | 84/726 |

(Continued)

FOREIGN PATENT DOCUMENTS

| | | | |
|---|---|---|---|
| GB | WO8704288 | A2 | 7/1987 |

*Primary Examiner*—David S. Warren
(74) *Attorney, Agent, or Firm*—Stoneman Volk Patent Group; Martin L. Stoneman; Michael D. Volk, Jr.

(57) ABSTRACT

A musical instrument pickup comprising a plurality of coil-wire wrappings, each coil having a particular geometric cross-section. Each coil-wire wrapping is positioned around a pole piece. Related embodiments exhibiting noise cancellation features are also disclosed.

22 Claims, 8 Drawing Sheets

U.S. PATENT DOCUMENTS

2006/0112816 A1* 6/2006 Kinman ..... 84/728
2006/0150806 A1* 7/2006 Hara ..... 84/726
2006/0272469 A1* 12/2006 Meisel ..... 84/21
2007/0056435 A1* 3/2007 Juszkiewicz et al. ..... 84/726

* cited by examiner

MUSICAL INSTRUMENT PICKUP

CROSS REFERENCE TO RELATED APPLICATIONS

The present application is related to and claims priority from prior provisional application Ser. No. 60/923,607, filed Apr. 16, 2007, entitled "MUSICAL INSTRUMENT PICKUP", and is related to and claims priority from prior provisional application Ser. No. 60/995,610, filed Sep. 26, 2007, entitled "MUSICAL INSTRUMENT PICKUP", the contents both of which are incorporated herein by this reference and are not admitted to be prior art with respect to the present invention by the mention in this cross-reference section.

BACKGROUND

This invention relates to musical instrument pickups. More particularly this invention relates to providing a musical instrument pickup with improved sensitivity between magnetic pole pieces of the musical instrument pickup assembly. Also, this invention relates to providing a musical instrument pickup capable of fitting within a limited space wherein the musical instrument pickup achieves an output similar to that of a typical musical instrument pickup and a reduction in noisy interference while still maintaining musician-approved tonal quality.

Certain musical instruments, especially electric guitars and other electric stringed instruments, typically use a magnetic transducer to convert mechanical string vibrations into electrical signals. The electrical signals are subsequently amplified with an amplification system and "played" through a loudspeaker. A musician typically selects musical-instrument electronic components to achieve a particular musician-desired tonal quality. For example, a guitar player may prefer analog circuitry to digital circuitry to achieve a more "vintage" tone. A guitar player's tone is directly related to the selection of desired amplifiers, guitars, and pickups (in addition to the playing style, finger pressure, etc., of the guitar player). With respect to guitar pickups, many factors, such as the number of coil winds, wire types, magnets, etc., affect a musician's tonal quality. Tonal quality is important as it imparts an expressive element from a musician to a listener.

Typical electric guitars use single-coil pickups. These typical single-coil pickups are susceptible to noisy interference known as "sixty cycle hum". Current solutions used to dissipate the noisy interference have a considerably different tonal quality than that of single-coil pickups. For example, "humbucking" pickups have a sound that is considered "fatter" and "thicker" than single-coil pickups that those knowledgeable in the art clearly are aware of and appreciate.

Thus, there is a need for a musical instrument pickup that is less noisy than typical single-coil pickups, wherein the noise dissipation does not detract from the characteristic tonal quality of a single-coil pickup.

OBJECTS AND FEATURES OF THE INVENTION

A primary object and feature of the present invention is to provide a system overcoming the above-mentioned problems. It is a further object and feature of the present invention to provide a musical instrument pickup with improved pickup sensitivity between pole pieces. Still a further object and feature of the present invention is to provide a musical instrument pickup that is less noisy than typical single-coil pickups wherein the noise dissipation does not detract from the characteristic tonal quality of a single-coil pickup. A further object and feature of the present invention is to provide components that may be assembled together to construct a musical instrument pickup that overcomes the above-mentioned problems and meets the needs disclosed herein. A further object and feature of the present invention is to provide a method of constructing such a musical instrument pickup. A further object and feature of the present invention is to maximize the pickup output within a given available space.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a musical instrument pickup system, relating to a stringed instrument having at least one string, comprising: a plurality of independent coil-wire wrappings, each having a geometric cross-section, able to be arranged together in an interlocking fashion; a plurality of pole pieces; wherein at least one coil-wire wrapping of such plurality of coil-wire wrappings surrounds at least one pole piece of such plurality of pole pieces; wherein, when such plurality of coil-wire wrappings are arranged in an interlocking fashion, adjacent coil-wire wrappings exhibit at least one coil-wire overlap between each pole piece of such plurality of pole pieces. Moreover, it provides such a musical instrument pickup, wherein such a geometric cross-section is a rhombic cross section. Additionally, it provides such a musical instrument pickup, wherein: such plurality of independent coil-wire wrappings comprises a plurality of independent coil-wire wrappings wherein such geometric cross-section is a rhombic cross section, and at least two independent coil-wire wrappings wherein such geometric cross-section is a partially rhombic and partially semicircular cross-section; wherein such plurality of independent coil-wire wrappings having a rhombic cross-section are end capped by such at least two independent coil-wire wrappings having a partially rhombic and partially semicircular cross-section. Also, it provides such a musical instrument pickup, wherein each coil-wire wrapping forms a coil angle between a bottom region of a coil-wire wrapping and a corresponding perpendicular string of the stringed instrument. In addition, it provides such a musical instrument pickup, wherein such coil angle comprises a value between about 39 degrees and about 59 degrees. And, it provides such a musical instrument pickup, wherein such coil angle comprises a value of less than about 50 degrees. Further, it provides such a musical instrument pickup, wherein such coil angle comprises a value of about 39 degrees. Even further, it provides such a musical instrument pickup, wherein at least one coil-wire wrapping of such plurality of independent coil-wire wrappings comprises at least one supportive template around which coil wire is wrapped. Moreover, it provides such a musical instrument pickup, wherein such at least one template comprises a rhombic cross-section. Additionally, it provides such a musical instrument pickup, wherein such at least one template comprises an oval cross section. Also, it provides such a musical instrument pickup, wherein at least one pole piece, of such plurality of pole pieces, comprises a rhombic cross-section. In addition, it provides such a musical instrument pickup, wherein at least one pole piece, of such plurality of pole pieces, comprises an oval cross-section. And, it provides such a musical instrument pickup, wherein such plurality of independent coil-wire wrappings, when arranged in an interlocking fashion are aligned in a substantially straight line. Further, it provides such a musical instrument pickup system, wherein such coil wire comprises a coil-wire gauge between about 45 gauge and about 42 gauge. Even further, it provides such a musical instrument pickup, wherein at least one of such plurality of pole pieces are magnetic.

In accordance with another preferred embodiment hereof, this invention provides a musical instrument pickup, relating to noise cancellation, comprising: a plurality of independent coil-wire wrappings, each having a geometric cross-section, able to be arranged together in an interlocking fashion; a plurality of magnetic pole pieces; wherein at least one coil-wire wrapping of such plurality of coil-wire wrappings surrounds at least one magnetic pole piece of such plurality of magnetic pole pieces; wherein, when such plurality of independent coil-wire wrappings are arranged in an interlocking fashion, adjacent coil-wire wrappings exhibit at least one coil-wire overlap between each pole piece of such plurality of pole pieces; wherein at least two independent coil-wire wrappings of such plurality of coil-wire wrappings comprise a coil-wire winding direction; wherein at least two magnetic pole pieces of such plurality of pole pieces comprises a magnetic pole orientation; wherein, to achieve noise cancellation, such at least two independent coil-wire wrappings comprise opposite coil-wire winding directions and such at least two magnetic pole pieces comprises opposite magnetic pole orientations.

In accordance with another preferred embodiment hereof, this invention provides a component of a musical instrument pickup, relating to supporting coil wire, such component comprising: a supportive template around which coil wire is to be wrapped, such at least one supportive template comprising a geometric cross-section; wherein at least two of such supportive template are structured and arranged to fit together in an interlocking fashion; wherein, when at least two of such supportive template are arranged in such interlocking fashion, and when each such supportive template is wrapped with coil wire, at least one coil-wire overlap is present between adjacent supportive templates.

In accordance with another preferred embodiment hereof, this invention provides a method of constructing a musical instrument pickup, relating to achieving a user-desired signal output level and a user-desired tonal characteristic from a stringed instrument, comprising the steps of: selecting at least one geometric cross-section to embody a plurality of independent coil-wire wrappings, each independent coil-wire wrapping of such plurality able to be arranged together in an interlocking fashion; wherein the step of selecting such at least one geometric cross-section comprises the step of selecting at least one coil angle between a bottom region of each independent coil-wire wrapping and a corresponding perpendicular string of the stringed instrument; selecting at least one coil-wire gauge for each independent coil-wire wrapping; selecting a number of winding turns of such selected coil-wire gauge for each independent coil-wire wrapping; assembling, for use with the stringed instrument, a plurality of independent coil-wire wrappings having such selected geometric cross-section, such selected coil angle, such selected coil-wire gauge, and such selected number of winding turns. Even further, it provides such a method, wherein, when such plurality of independent coil-wire wrappings are interlocked, adjacent coil-wire wrappings exhibit at least one coil-wire overlap. Even further, it provides such a method, further comprising the step(s) of: selecting a magnetic-pole orientation of at least one magnetic pole piece; selecting at least one winding direction for each independent coil-wire wrapping; arranging, for noise cancellation purpose, such selected magnetic-pole orientation and such selected winding direction. Even further, it provides such a method, wherein the step of arranging such selected magnetic pole piece pole orientation comprises the step(s) of: selecting, for each string of the stringed instrument, placement, in relation to a string of the stringed instrument, of such selected magnetic-pole orientation; selecting, in relation to other coil-wire wrappings, placement of such selected winding direction. Even further, it provides such a method, wherein the step of arranging such selected magnetic pole piece pole orientation comprises the step(s) of: selecting, for each string of the stringed instrument, placement, in relation to a string of the stringed instrument, of such selected magnetic-pole orientation; selecting, in relation to other coil-wire wrappings, placement of such selected winding direction. Even further, it provides such a method, further comprising the step(s) of selecting dimensions of such selected geometric cross-section to fit the stringed instrument.

DETAILED DESCRIPTION OF THE BEST MODES AND PREFERRED EMBODIMENTS OF THE INVENTION

Figure 1:
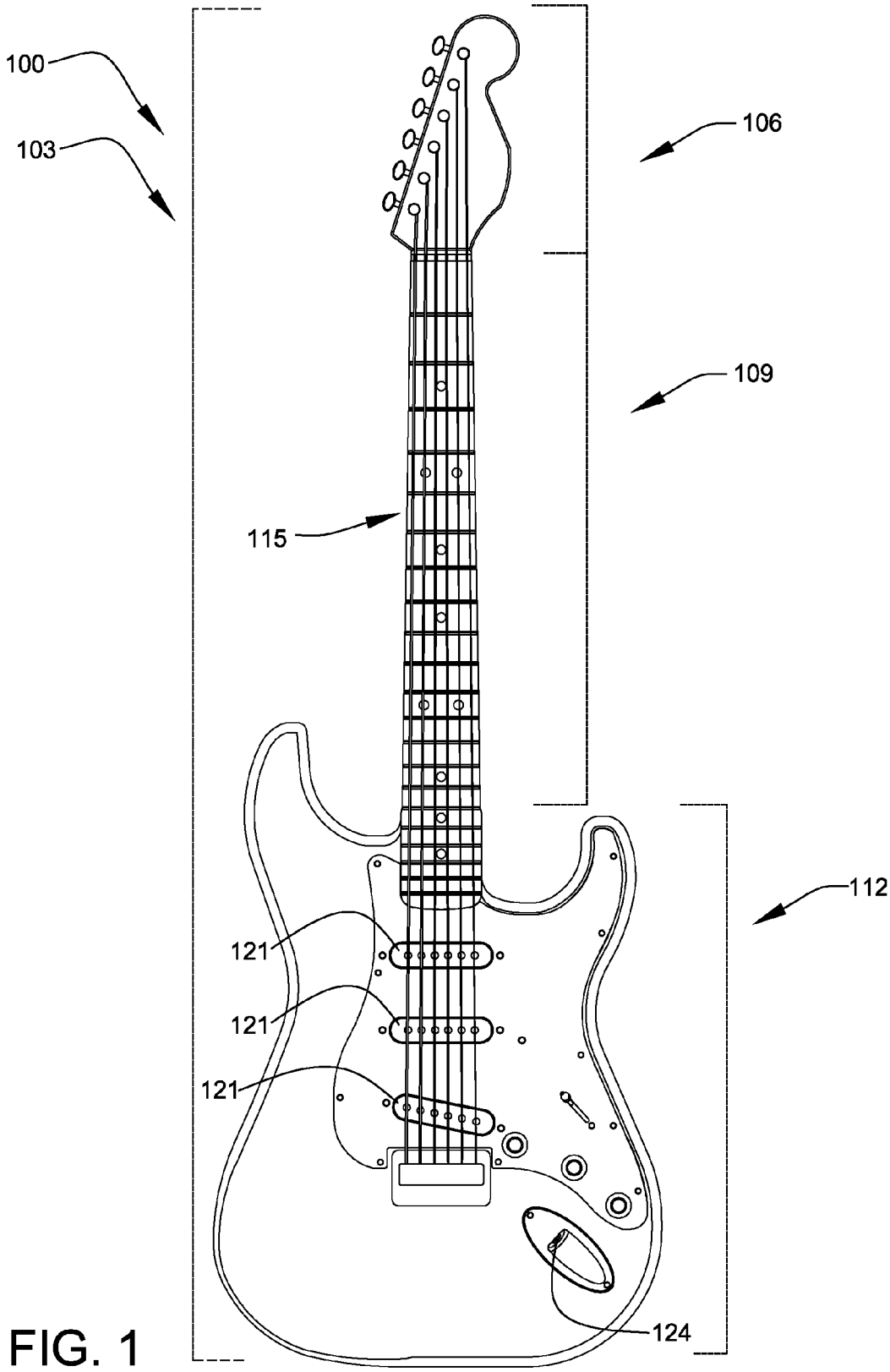
FIG. 1 shows a plan view of a musical instrument, an electric solid body guitar.

FIG. 1 shows a plan view of stringed instrument 100, an electric solid body guitar. As shown in FIG. 1, musical instrument 100, preferably guitar 103, which is illustrative of a typical solid-body electric guitar, comprises headstock 106, neck 109, and body 112. Upon reading the teachings of this specification, those of ordinary skill in the art will now understand that, under appropriate circumstances, considering such issues as trends in musician preferences, etc., other stringed instruments, such as, for example, a hollow body electric guitar, a semi-hollow body electric guitar, an electric guitar with more than six strings, e.g., a seven-string electric guitar, a twelve-string electric guitar, etc., an electric guitar with less than six strings, a electric double-neck guitar, a carved-top electric guitar, an arch-top electric guitar, an acoustic-electric guitar, an electric mandolin, an electric violin, an electric banjo, an electric stringed instrument with more than six strings, an electric stringed instrument with less than six strings, etc., may suffice.

Guitar 103 comprises strings 115 which typically comprise steel. Guitar 103, shown in FIG. 1, is commonly referred to as a six-string guitar. Strings 115 of guitar 103 are under tension from headstock 106 to a position on body 112, namely, tail-piece assembly 122, as shown. A six-string guitar, as shown in FIG. 1, comprises six strings ranging in diameter to produce different tones. Each string of strings 115 is tuned to a particular guitarist-desired pitch.

Body 112 of guitar 103 comprises electronic components 118 that assist in converting mechanical vibration of strings 115 into electrical signals. Those electrical signals are typically subsequently amplified and sounded through a loud speaker. A guitarist "frets" (i.e., changes the effective string length by pushing the string against the neck) strings 115 and vibrates strings 115 with either the fingers of the guitarist or with a plectrum, also referred to as a "flatpick" or "pick", to perform music with guitar 103.

Electronic components 118 of guitar 103 comprise "pick-ups" 121, as shown. Pickups are magnetic transducers that induce a current in wound coil wire positioned adjacent to a magnet. Guitar 103, shown in FIG. 1, comprises three of pickup 121. A typical guitar comprises at least one pickup 121. Electronic components 118 of guitar 103 are electrically connected to each of pickup 121 in such a way that a guitar player may select which pickup or combination of pickups will be used. This pickup selection is performed to shape the tone of the guitarists sound and provides an expressive musical component. In operation, the mechanical vibration of strings 115, such strings typically comprising steel or metal, in magnetic-field communication with a pickup, induces a current in the wound coil wire by affecting the magnetic flux of the adjacent magnet. The induced current signal, when electrically connected to an amplifier, is subsequently amplified. The amplified electric signal may then be sounded through a loud speaker as the electrical signal is converted into a mechanical wave signal.

Figure 2:
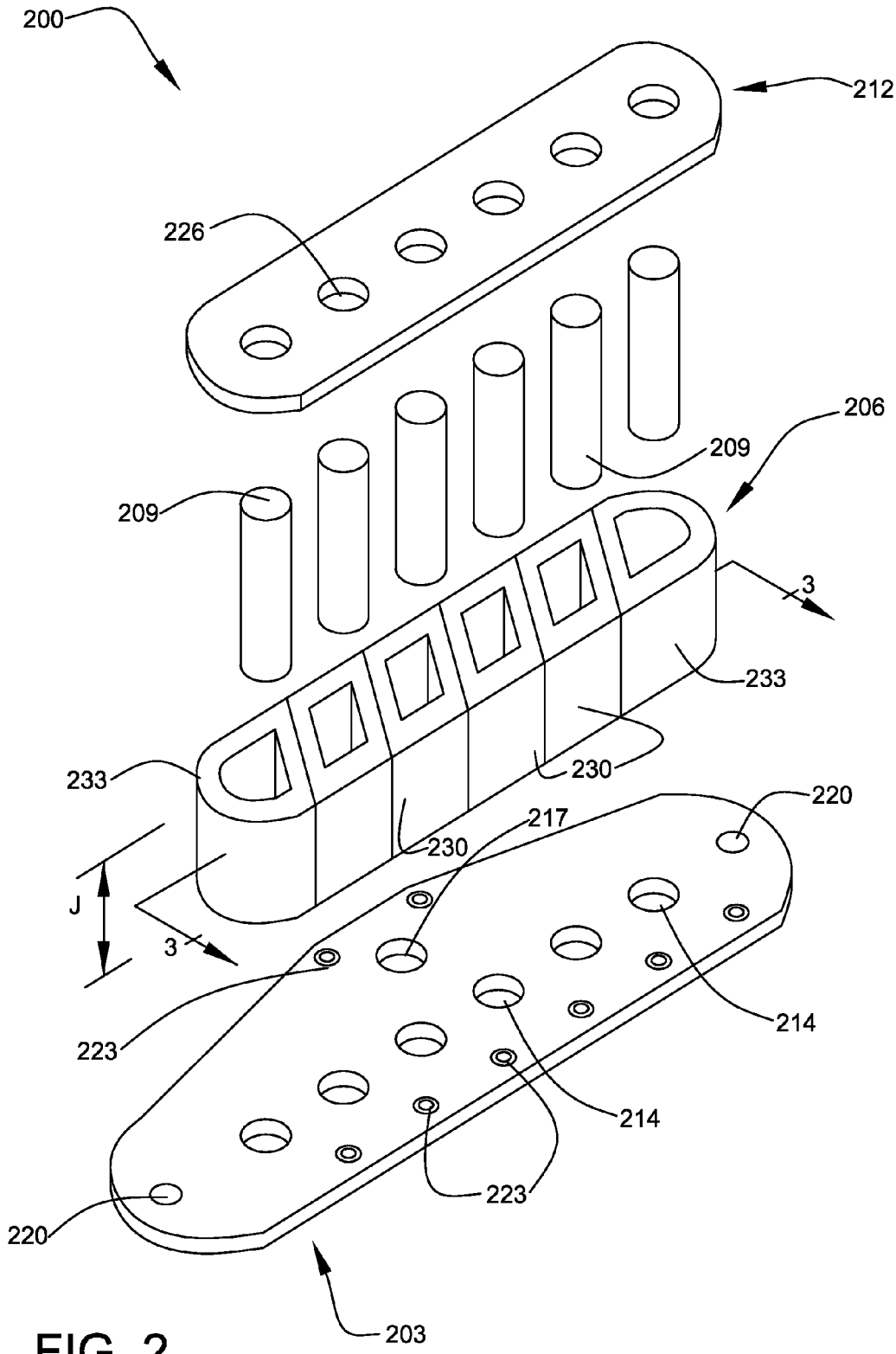
FIG. 2 shows an exploded view illustrating the components of a musical instrument pickup according to a preferred embodiment of the present invention.

FIG. 2 shows an exploded view illustrating the components of a preferred musical instrument pickup according to a preferred embodiment of the present invention. Musical instrument pickup 200 comprises the following components: bottom flatwork 203, coil assembly 206, six of pole piece 209, and top flatwork 212, as shown. Musical instrument pickup 200 is preferably designed to be compatible with the dimensions and sizing of a conventional single-coil pickup for a six-string electric guitar such that musical instrument pickup 200 will fit within a standard single-coil pickup equipped guitar, such as guitar 103 of FIG. 1, without the need for modification. Upon reading the teachings of this specification, those of ordinary skill in the art will now understand that, under appropriate circumstances, considering such issues as musician preference, future developments in musical pickup design, intended use, etc., other compatible pickup geometries and dimensions, such as a "P90" style pickup, a "full-size" "humbucking" style pickup, a Nano-mag style pickup, etc., may suffice.

Bottom flatwork 203 preferably comprises bottom pole piece apertures 214, preferably arranged in a row, as shown. Each bottom pole piece aperture 214 is designed to hold a portion of each pole piece 209 preferably with a friction fit. Alternately preferably, each pole piece 209 may be secured within pole piece aperture with an adhesive or wax. Each pole piece aperture 214 has a preferred diameter of about 0.19 inches. Bottom flatwork 203 preferably has an overall pole piece spacing of about 2.0625 inches with spacing between adjacent pole pieces of preferably about 0.4125 inches (such spacing measured from the center of each pole piece aperture center). Upon reading the teachings of this specification, those of ordinary skill in the art will now understand that, under appropriate circumstances, considering such issues as other desired flatwork dimensions, type of guitar, etc., other aperture diameters, other overall pole piece spacing dimensions, and other spacing between adjacent pole pieces, etc., may suffice.

Bottom flatwork 203 preferably comprises lead wire aperture 217 for routing lead wire from musical instrument pickup 200 essentially to output jack 124 of guitar 103 (see FIG. 1). Preferably, lead wire aperture 217 has a preferred diameter of about 0.157 inches. It is noted that lead wire from multiple musical pickup assembly 200 may be internally configured, or "wired", within a stringed instrument in a multitude of ways with other guitar components, such as switches, tone controls, and volume controls, to achieve particular musical tones.

Bottom flatwork 203 also preferably comprises mounting screw aperture 220 to receive a mounting screw to secure bottom flatwork 203 and musical instrument pickup to a guitar. Preferably, mounting screw aperture 220 has a preferred diameter of about 0.09 inches. Preferably, musical instrument pickup will be preferably height adjustable within musical instrument using art-recognized springs and mounting screws.

Bottom flatwork 203 also preferably comprises eyelets 223 to connect electrical lead connections. Bottom flatwork 203 preferably comprises two grouping of eyelets 223. A first grouping of eyelets 223 is preferably positioned near an edge of bottom flatwork 203 and between each pole piece apertures 214, as shown. First grouping of eyelets 223 preferably comprises six of eyelets 223 (preferred for a six-string electric guitar). A second grouping of eyelets 223 are preferably positioned opposite the first grouping of eyelets 223, as shown. Second grouping of eyelets 223 preferably comprises two of eyelets 223, as shown. All eyelets 223 preferably comprise brass. Upon reading the teaching of this specification, those of ordinary skill in the art will now understand that, under appropriate circumstances, considering such issues as flatwork geometry, lead wire length, etc., other arrangements for eyelets on flatwork, such as all eyelets arranged on a single side of flatwork, etc., may suffice. Coil wire from each coil-wire wrapping is preferably soldered on an underside of bottom flatwork 203. Lead wire is preferably soldered to appropriate eyelets and wired essentially to an output jack of musical instrument.

Bottom flatwork 203 has a preferred width of about 0.916 inches, a preferred length of about 3.27 inches, and a preferred thickness of about 0.093 inches. Upon reading the teachings of this specification, those of ordinary skill in the art will now understand that, under appropriate circumstances, considering such issues as guitar type, pickup shape, etc., other dimensions of bottom flatwork may suffice.

Bottom flatwork 203 is preferably made of black vulcanized fiber.

Top flatwork 212 preferably comprises top flatwork apertures 226. Top flatwork 212 has the following preferred dimensions: width of about 0.61 inches, length of about 2.595 inches, thickness of about 0.062 inches, top flatwork apertures 226 diameter of about 0.185 inches, overall pole piece spacing of about 2.0625 inches with spacing between pole pieces of about 0.4125 (measured from the center of each pole piece aperture centers), and a center hole (not shown) having a diameter of about 0.107 inches. Upon reading the teachings of this specification, those of ordinary skill in the art will now understand that, under appropriate circumstances, considering such issues as guitar type, pickup shape, etc., other dimensions of top flatwork may suffice.

Top flatwork 212 is preferably made of black vulcanized fiber.

Preferred flatwork, both top flatwork components and bottom flatwork components, is available from Stewart-McDonald of Athens, Ohio. A preferred set of pickup flatwork designed for a Stratocaster® guitar is item #5955 made available from Stewart-McDonald of Athens, Ohio. Upon reading the teachings of this specification, those of ordinary skill in the art will now understand that, under appropriate circumstances, considering such issues as guitar type, pickup shape, etc., other pickup flatwork designed to fit other guitar types may suffice.

Coil assembly 206 is preferably "sandwiched" between top flatwork 212 and bottom flatwork 203, as shown. Coil assembly 206, preferably comprises four independent coil-wire wrappings each having a rhombic cross section (the "center" coil-wire wrappings) preferably capped on each end by one independent coil-wire wrapping having a rhombic/semi-circular cross section (the "end" coil wire wrappings), as shown. Alternately preferable, coil assembly 206 may be comprised entirely of interlockable coil wrappings preferably comprising a rhombic cross-section (see FIG. 7). Upon reading the teachings of this specification, those of ordinary skill in the art will now understand that, under appropriate circumstances, considering such issues as cost, materials available, amount of coil wire to be used, other coil assembly arrangements, such as having non-coil-wrapped pieces having a semi-circular cross section capping a coil wrapping having a rhombic cross section so that an assembled coil assembly will fit within a conventional guitar, etc., may suffice.

The individual coil-wire wrappings of musical instrument pickup 200 preferably interlock, or fit together in a corresponding fashion, as shown. Preferably, the individual coil-wire wrappings are secured by flatwork. Alternately preferably, the individual coil-wire wrappings may be secured to flatwork with an adhesive or a wax.

Musical instrument pickup 200 preferably comprises six pole pieces 209 having a preferred outer diameter of about 0.1875 inches. Pole pieces 209 are preferably Alnico V magnets. Pole pieces 209 are preferably self-magnetized. Alternately preferably, pole pieces 209 may be magnetically-conductive slugs influenced by an auxiliary magnet. Upon reading the teachings of this specification, those of ordinary skill in the art will now understand that, under appropriate circumstances, considering such issues as tonal preferences, output requirements, etc., other magnetic materials, such as Alnico II magnets, ceramic magnets, etc., may suffice.

Each individual coil-wire wrapping of coil assembly 206 is preferably oriented around a single magnetic pole piece 209, as shown. Upon reading the teachings of this specification, those of ordinary skill in the art will now understand that, under appropriate circumstances, considering such issues as designer preference, tonal quality desired, intended use, etc., other coil wrapping/magnetic pole piece arrangements, such as, having a coil wrapping oriented around more than one magnetic pole piece, such as around two adjacent magnetic pole pieces, around three adjacent magnetic pole pieces, around four adjacent magnetic pole pieces, around five adjacent magnetic pole pieces, etc., may suffice.

Musical instrument pickup 200 is preferably assembled by press fitting pole pieces 209 surrounded by individual coil-wire wrappings into the corresponding apertures in top flatwork 212 and bottom flatwork 203. Alternately preferably, a fastening agent such as glue, silicone caulk, or wax may be used to fix musical instrument pickup 200 together. One advantage of using a fastening agent is to prevent coils from being subject to vibration. Preferably, the individual coil windings of coil assembly 206 may be electrically coupled using eyelets 233 positioned on the side opposite of the flatwork with respect to the external lead connections, as shown in FIG. 2. Alternately preferably, all eyelets are positioned on a single side of flatwork.

Musical instrument pickup 200 is preferably wired so as to be in electronic communication with the output jack of a guitar. Coil-wire wrapping preferably comprises copper coil-wire. Individual coil wires are preferably soldered to bottom flatwork 203 after threading coil wire through an appropriate eyelet 223. Excess coil wire is preferably clipped away, and a spot of solder is placed on the eyelet, preferably on the underside of flatwork 203. One of the lead wires each from coils 1 and 6 is also preferably connected to the main lead wires connected to the second grouping of eyelets 223 to provide for external electric connection. Preferably, the individual coils-wire wrappings are wired in series. Upon reading the teachings of this specification, those of ordinary skill in the art will now understand that, under appropriate circumstances, considering such issues as user preference, intended use, desired tone, noise cancellation, etc., other wiring arrangements, such as wiring each coil wrapping in parallel, wiring groups of coil wrappings in series, wiring in parallel groups of coil wrapping wired in series with other groups of coil wrapping wired in series, etc., may suffice.

In the preferred embodiment of FIG. 2, each coil is preferably configured with the same winding direction (or electron travel) and magnetic polarity.

Figure 3:
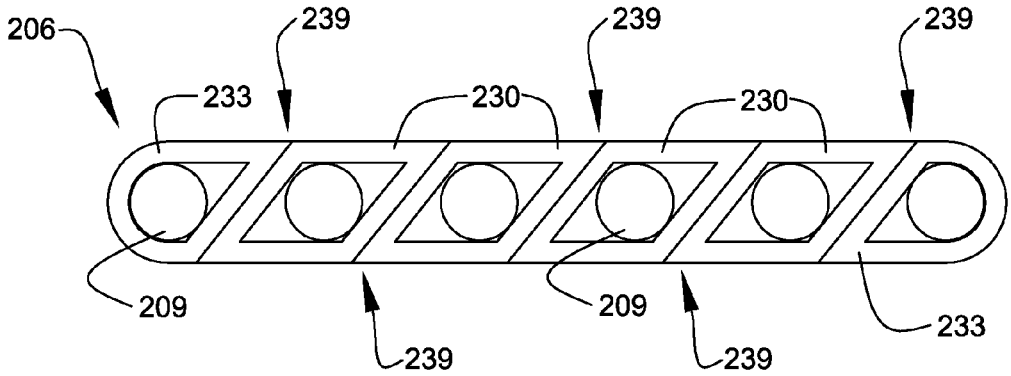
FIG. 3 shows a sectional view, through the section 3-3, of the coil wire portion of the musical instrument pickup of FIG. 2.

FIG. 3 shows a sectional view, through the section 3-3, of the coil-wire portion of the musical instrument pickup of FIG. 2. As stated above, coil-wire portion 206 of musical instrument pickup 200 comprises individual coil-wire wrappings, namely coil-wire wrapping 230 and coil-wire wrapping 233, as shown. In FIG. 3, two preferred shapes of coil-wire wrapping are shown. The coil-wire wrappings have a preferred geometric cross-section. The first preferred shape/geometric cross-section is a coil-wire wrapping having a rhombic cross section, as shown. Four coil-wire wrappings of this first preferred shape, coil-wire wrapping 230, are shown in FIG. 3. The second preferred shape/geometric cross-section is a coil-wire wrapping having a partially rhombic/partially circular cross section, as shown. Two coil-wire wrappings of this second preferred shape, coil-wire wrapping 233, are preferably used with a six-string guitar. This second preferred shape "caps" the centrally-arranged grouping of first preferred shapes.

A major preferred feature of musical instrument pickup and musical instrument pickup 200 is the overlapping coil wire, coil-wire overlap 239, in regions between pole pieces 209, as shown. The independent coil wrappings of musical instrument pickup 200 each have a preferred geometric cross-section. In FIG. 3, the preferred geometric cross section is a rhombus for the center coil-wire wrappings, coil-wire wrapping 230, and a partial rhombus/partial semicircle for the end coil-wire wrappings, coil-wire wrapping 233. Each independent coil-wire wrapping preferably surrounds pole piece 209, as shown. When the independent coil-wire wrappings are arranged in an interlocking fashion, adjacent coil-wire wrappings exhibit coil-wire overlap 239 between consecutive pole pieces. Coil-wire overlap 239 assists in providing maximum coil wire within a given limited space.

Note that the coils situated at the "caps" of coil wire portion (beneath strings 1 and 6 in a conventional six string guitar) follow the rhombic cross section on the inner half of the coil wrapping, but the outer free surface cross-section is preferably semicircular. This shape is preferred as it allows for the retrofit of musical instrument pickup 200 into a conventional single-coil pick up geometry space. It is also preferred that all six coil wrappings have a rhombic cross-section (see FIG. 9) with both a cylindrical magnetic pole piece or a magnetic pole piece having a geometric cross-section corresponding to a particular coil-wrapping cross section.

Figure 4:
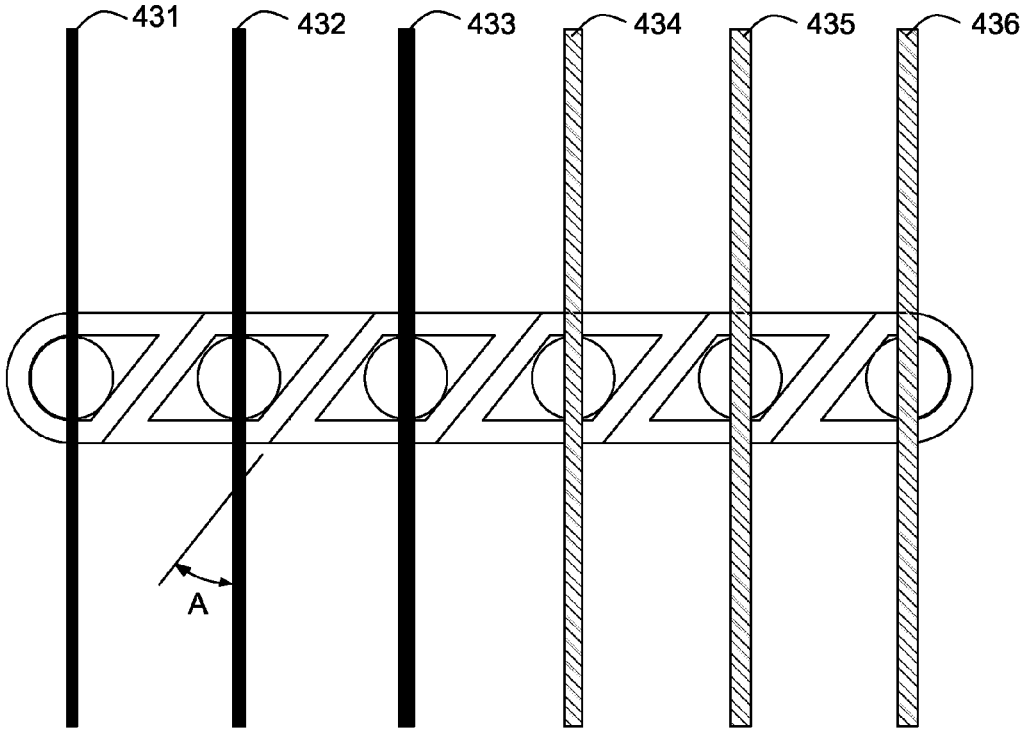
FIG. 4 shows the sectional view of FIG. 3 further illustrating musical instrument string orientation relative to coil orientation.

FIG. 4 shows the sectional view of FIG. 3 further illustrating musical instrument string orientation relative to coil orientation. Musical instrument pickup 200 is intended to be placed beneath strings of a stringed musical instrument, such as a guitar, as shown in FIG. 4. Each guitar string is positioned above pole piece 209 of musical instrument pickup 200, as shown. Shown in FIG. 4 is a typical guitar string arrangement for a six-string guitar. Six-string guitars have six strings, namely, first guitar string 431 (also typically referred to as the high "e" string), second guitar string 432 (also typically referred to as the "b" string), third guitar string 433 (also typically referred to as the "G" string), fourth guitar string 434 (also typically referred to as the "D" string), fifth guitar string 435 (also typically referred to as the "A" string), and sixth guitar string 436 (also typically referred to as the low "E" string), as shown.

Musical instrument pickup 200 forms coil angle A defined as the angle between the base side of a coil-wire wrapping and a corresponding perpendicular string. Coil angle A has a preferred value range between 59 degrees and 39 degrees, preferably less than fifty degrees, with one preferred value of 49, and with a theoretical preferred value of 39 degrees. The value of coil angle A is equal to ninety degrees less the value of the acute angle formed by the intersection of the base of the coil wrapping and the side of the coil wrapping. To more fully illustrate the coil angle value concept, for a preferred value for the acute angle formed by the intersection of the base of the coil wrapping and the side of the coil wrapping of 51 degrees, the preferred value for the coil angle equals 39 degrees.

As discussed herein, the preferred coil angles provides many advantages. The primary advantage is that the preferred coil angles allow one to lower the cross-sectional area of the coil-wire wrapping while keeping an output similar to that of a single-coil guitar pickup by virtue of having a substantially equivalent amount of coil-wire/metal around the magnetic pole piece. Further, the preferred coil angles permit applicant to use a plurality of interlocking coil wrappings having a cross sectional area such that the pickup fields of adjacent coil/magnet pole piece pairs overlap in the space between the strings forming coil-wire overlap 239. A plurality of interlocking coil-wire wrappings having a parallelogram cross-section and using a preferred coil angle provides maximum coil-wire wrapping density in a given limited space and maximizes the musical instrument pickup's output in that given limited available space. It is preferred that the bases of the individual coil wrappings be aligned in a substantially straight line. Upon reading the teachings of this specification, those of ordinary skill in the art will now understand that, under appropriate circumstances, considering such issues as user preference, intended use, etc., other alignments of the bases of the coil wrappings, such as having the entire assembly tilted with respect to the string axis, such that the bases of all of the coils form a line at a non-normal angle with respect to the axis of the string, having a staggered, or stair-stepped, configuration of coil wrappings, etc., may suffice.

Typically, as one moves farther from the center of a conventional magnetic pole piece, the magnetic field strength decreases. While applicant does not intend to be bound by theory, it is hypothesized that in the space between pole pieces 209, the strength of signal coupling into the pickup will remain relatively constant since coil wire will occupy this space in a consistent manner. When engaging in "string bending", applicant's musical instrument pickup is highly preferred as the mechanical vibrations of the guitar strings occur between adjacent pole pieces for a period of time (the duration of the string bend). Coil-wire wrappings 230 exhibit signal coupling between adjacent pole pieces along a center line perpendicular to the direction of the guitar strings. With coil winding absent between adjacent pole pieces, this signal coupling is absent.

With respect to the direction parallel to the direction of the guitar strings, signal coupling has a smaller cross-sectional area due to the lower number of coil windings needed to achieve an output similar to that of a typical single-coil guitar pickup, and thus is inherently less "noisy" since the amount of noise is directly proportional to the number of coil windings.

One aspect of musical instrument pickup 200 concerns managing the balance between the gain, or increase, in signal sensitivity in the region between adjacent coil-wire wrappings and the resulting loss in overall pickup strength through the geometric limitations in coil-wire wrapping wall thickness due to the preferred cross-section of coil windings. As the coil angle is increased from a limit of zero degrees (a square or rectangle with the coil side parallel to the string axis) the allowable thickness of the coil winding is reduced due to geometric constraints. The theoretical maximum coil wall thickness allowable between adjacent magnetic pole pieces—when the distance between each adjacent pole piece is about 0.4125 inches (measured from center to center of adjacent pole piece) and assuming a magnetic pole piece diameter of about 0.1875 inches—is about 0.113 inches for a coil winding having a square cross section. A conventional single-coil pickup has a coil wall thickness of about 0.1875.

As an illustration, at a preferred coil angle of 39 degrees, and with coil-wire wrapping 230, a coil wall thickness of about 0.052 is allowable (with coil wall thickness being measured perpendicular to the winding direction in the direction parallel to the string). As stated above, applicant's preferred embodiment achieves, within a typical guitar pickup space, equivalent output to a typical single-coil guitar with less cross-sectional coil windings.

As the allowable coil wall thickness of applicant's preferred rhombic cross section of coil windings is less when compared with conventional single-coil pickups, some allowance may be required to compensate for the resulting loss of signal strength due to the reduced coil wall thickness and the subsequent loss in allowable space for additional coil windings. Two parameters may be adjusted to compensate for the reduced coil wall thickness and subsequent loss in allowable space for additional coil windings. Those two parameters are wire gauge and coil height.

With respect to wire gauge, typical single-coil pickups utilize 42-gauge copper wire and are typically wound with 5500-8000 turns of wire. Preferably, smaller than 42-gauge copper wire is used and permits more turns of wire in the smaller allowed space. Preferably, 45-gague copper wire is used, with 44-gauage copper wire being more preferred, and 43-gauge copper wire being most preferred. With 44-gauge copper wire, 7,500 turns are preferred. With 43-gauge copper wire, 6,000 turns are preferred. The more turns of coil wire, the more coil wire/metal is packed within a given space. With an equivalent amount of metal to a typical single coil pickup, the output will be essentially the same.

With respect to coil height, conventional single-coil pickups coils are about 0.4375 inches in height. Preferably, coil height J (see FIG. 2) of the coil-wire wrapping is greater than 0.4375 inches with a preferred height of about 0.5 inches. Combining increased coil height with lighter gauge copper wire would allow for the proposed pickup to have an extended output range as a higher number of windings may be used.

Figure 5:
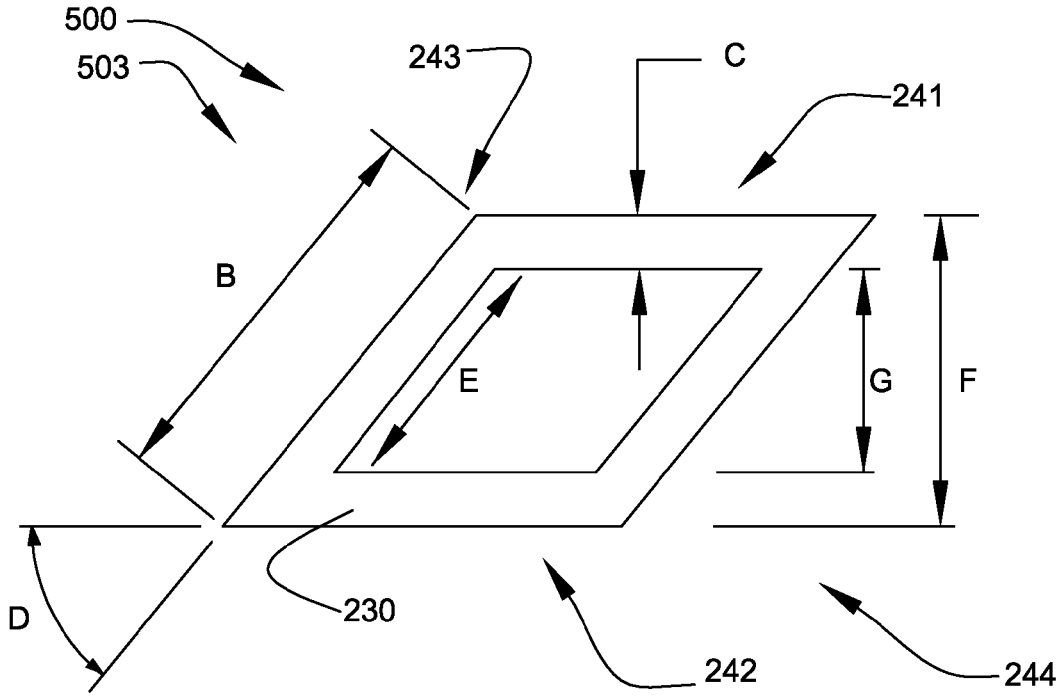
FIG. 5 shows a schematic view of a preferred "center" coil of FIG. 2.

FIG. 5 shows a schematic view of a preferred "center" coil of FIG. 2.

Coil-wire wrapping 230 having a rhombic cross section is the preferred coil wrapping configuration to be placed beneath second guitar string 432, third guitar string 433, fourth guitar string 434, and fifth guitar string 435 of a six-string guitar in the preferred embodiment of FIG. 2. Coil-wire wrapping 230 comprising rhombic cross section comprises four sides having an external width and an internal width defining coil-wire wrapping thickness C. Coil-wire wrapping thickness C is dependent on the gauge of coil wire and on the number of turns of coil wire used. Coil-wire wrapping preferably comprises top region 241, bottom region 242, left region 243, and right region 244, as shown. Coil-wire wrapping 230 preferably has geometrically shaped cross section 500, preferably rhombus cross-section 503, as shown. Preferably coil-wire wrapping comprises side length B. All sides of coil-wire wrapping 230 are congruent. In one preferred embodiment, the value for side length B of coil-wire wrapping 230 is preferably about 0.39 inches. The value for interior length E of coil-wire wrapping 230 is preferably about 0.257 inches. The distance from the top of top region 241 to the bottom of bottom region (measured at a ninety degree angle from the top side) is distance F, as shown. Distance F is preferably about 0.303 inches. Distance G, the internal distance from a lower portion of top region 241 to a top portion of bottom region 242 is preferably about 0.2 inches. Angle D has a preferred value of about 51 degrees. Adjacent sides of rhombus 503 are supplementary so that the corresponding angle of angle D has a value of 129 degrees. Upon reading the teachings of this specification, those of ordinary skill in the art will now understand that, under appropriate circumstances, considering issues such as chosen coil angle, desired coil-wall thickness, coil wire gauge, use of a coil wire template or support, other dimensions of coil wrapping, may suffice.

Figure 6:
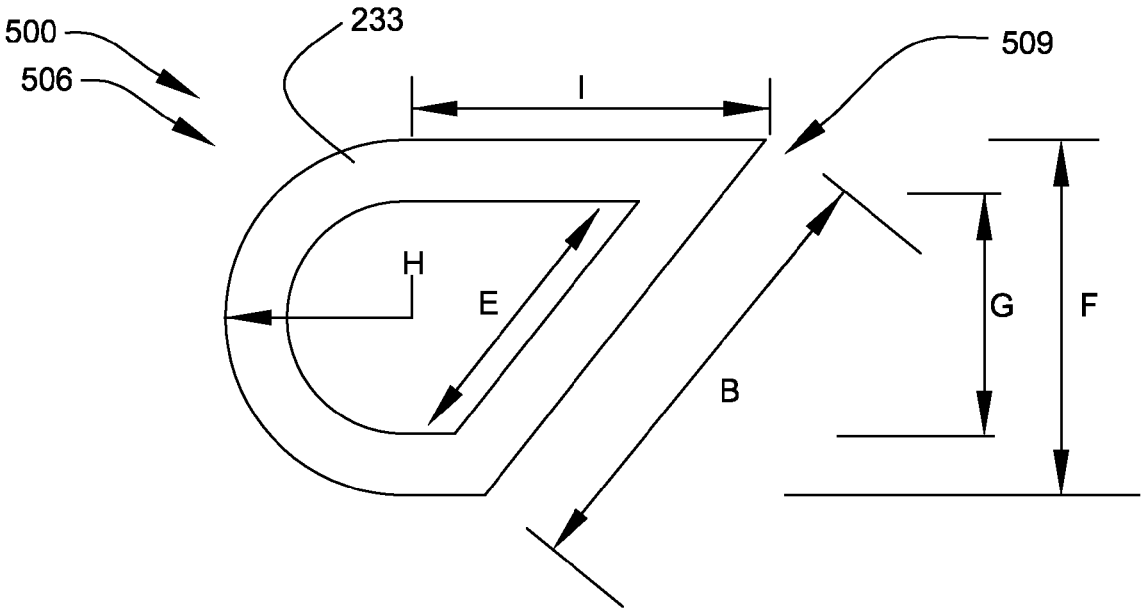
FIG. 6 shows a schematic view of a preferred "end" coil of FIG. 2.

FIG. 6 shows a schematic view of an "end" coil according to a preferred embodiment of the present invention.

Coil-wire wrapping 233 comprising rhombic/circular cross-section 506 is the preferred coil wrapping configuration to be placed beneath first guitar string 431, and sixth guitar string 436 of a six-string guitar. The dimensions of rhombic portion 509 of coil-wire wrapping 233 are similar to those described with respect to coil-wire wrapping 230 shown of FIG. 5. A preferred value radius H of semi-circular portion is about 0.1 inches.

Figure 7:
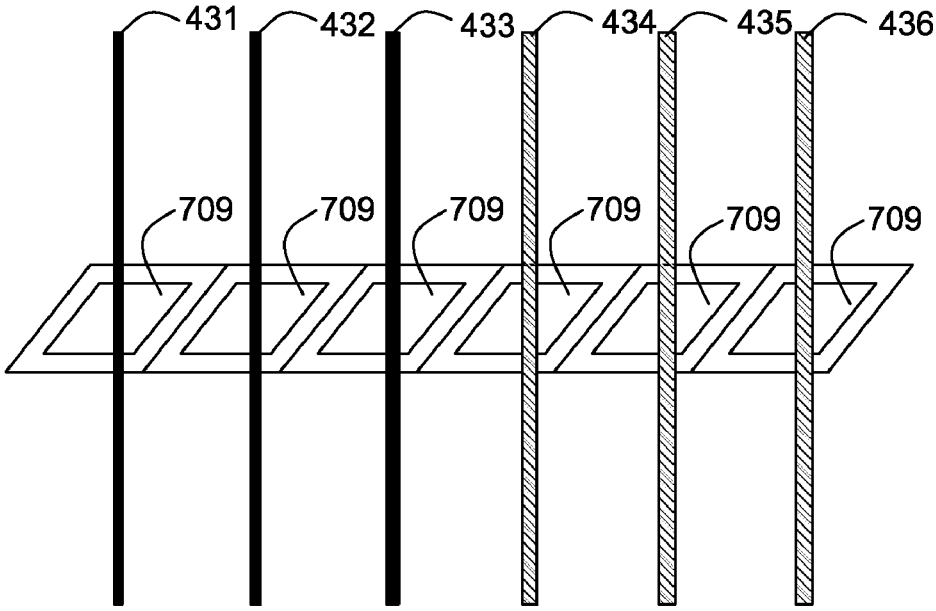
FIG. 7 shows a schematic sectional view illustrating a particular magnetic pole piece shape, namely a rhombus, and associated coil winding of a coil-wire portion of a musical instrument pickup according to another preferred embodiment of the present invention.

FIG. 7 shows a schematic view illustrating a particular pole piece shape, namely a rhombus, and associated coil winding of a coil-wire portion of a musical instrument pickup according to another preferred embodiment of the present invention. In the embodiment of FIG. 7, pole piece 709 shown would preferably comprise a rhomboidal cross-section, as shown. Alternately preferably, for placement beneath the first string and sixth string, a pole piece would preferably have a partial rhomboidal cross section on the inside facing half and a semicircular cross-section on the outside facing half (similar to the geometric shape of coil-wire wrapping shown in FIG. 6). The coil-wire wrapping associated with these magnets would employ a similar cross section. In the embodiment shown in FIG. 7, the coil wire wrapped around pole pieces 709 are preferably wound directly around the magnets. Alternately preferably, a self supporting coil with the same or substantially similar cross section may be fabricated and positioned around pole piece 709 in the final assembly.

Figure 8:
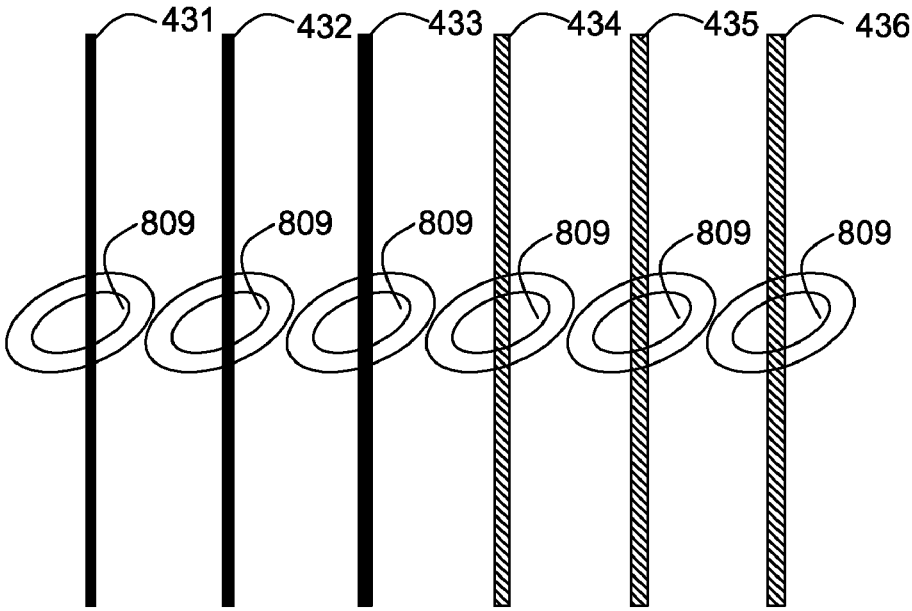
FIG. 8 shows a schematic sectional view illustrating a particular magnetic pole piece shape, namely an oval, and associated coil winding of a coil wire portion of a musical instrument pickup according to yet another preferred embodiment of the present invention.

FIG. 8 shows a schematic view illustrating a particular pole piece geometry, namely an oval, and associated coil winding of a coil wire portion of a musical instrument pickup according to yet another preferred embodiment of the present invention. In the embodiment of FIG. 8, pole pieces 809 preferably have an ovoid cross section with similarly shaped coil wire wrapped around the ovoid-shaped pole piece 809, as shown. As in FIG. 7, the coil wire may preferably be wrapped directly around the pole piece 809. Alternately preferably, a self supporting coil with the same or similar cross section may be fabricated and positioned around the ovoid pole pieces 809 in the final assembly.

Figure 9:
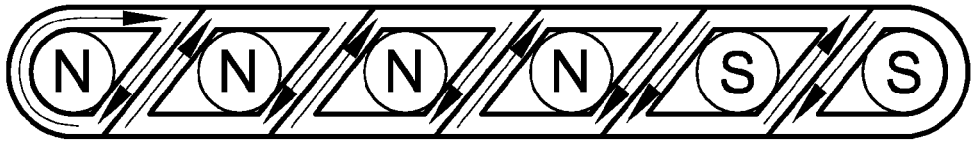
FIG. 9 shows a schematic view illustrating a particular magnetic pole orientation of the magnetic pole pieces of a musical instrument pickup used to achieve a noise-cancelling effect according to another preferred embodiment of the present invention.

FIG. 9 shows a schematic view illustrating a particular preferred magnetic pole orientation of the magnetic pole pieces of a musical instrument pickup used to achieve a noise-cancelling effect according to another preferred embodiment of the present invention.

Sixty cycle hum is a typical problem experienced by guitar players and is especially a problem in single-coil guitar pickups. For hum-cancelling performance, individual coil-wire wrappings may be configured such that opposing coils are configured in a reverse wound reverse polarity ("RWRP") configuration. Preferably, adjacent coil wrappings would have opposite polarity and winding direction compared with an adjacent coil wrapping. As an illustration, coil wrappings 1, 3 and 5 would have one magnetic polarity and winding direction while coil wrappings 2, 4 and 6 would have the opposite magnetic polarity and winding direction. In this preferred hum-canceling configuration, there is potential for partial signal cancellation in the region between the adjacent pole pieces due to the opposing magnetic fields. Preferably, magnetic shielding may be added to prevent adjacent coils from interfering with each other.

Other hum-canceling configurations are possible. As further illustration of the possibilities of hum-canceling arrangements provided with applicant's invention, coil wrappings 1, 2, and 3 may preferably comprise one magnetic polarity and winding direction while coil wrappings 4, 5, and 6 may preferably have an opposite magnetic polarity and winding direction. In this configuration, only the space between coil wrapping 3 and coil wrapping 4 would be subject to interference due to opposing magnetic polarity.

A compromise design, and a highly preferred embodiment of the hum-canceling musical instrument pickup of FIG. 9, would be to configure coil wrappings 1, 2, 3, and 4 with one magnetic polarity (N) and winding direction (clockwise) with coil wrappings 5 and 6 having an opposite magnetic polarity (S) and winding direction (counterclockwise). This preferred embodiment places the region of opposing magnetic fields between coil wrapping 4 and coil wrapping 5. This is advantageous since string 4, commonly referred to as the "D" string, is typically a wound string. Guitarists typically employ string "bending" to increase the pitch of the fretted note. String bending has the effect of shifting the center of the string vibration, relative to the coil, to the region between the adjacent coils. As strings are most commonly bent in an upward direction, in terms of string position relative to the player, the center of vibration is typically shifted towards the next highest coil wrapping/magnetic pole piece pair. As an illustration, the second string, commonly referred to as the "B" string, is more typically bent such that the center of vibration is shifted into the region between the second coil wrapping/magnetic pole piece pair and the third coil wrapping/magnetic pole piece pair. It is noted that a guitarist may bend a string downward; however, string bending is typically performed in an upward direction. It is uncommon in typical guitar playing practice to observe significant bending of the fourth string since it is thicker and also typically wound (comprise an outer winding around an inner core) making it more difficult to bend. First guitar string, second guitar string, and third guitar string (the high "e" string, the "B" string, and the "G" string) are typically "plain" and unwound, and are much more typically bent. As the fourth guitar string is not typically bent, placement of signal loss between the fourth and fifth coil wrapping/magnetic pole piece pair much less significant than if the placement of signal loss was positioned between the second coil wrapping/magnetic pole piece pair and third coil wrapping/magnetic pole piece pair. The advantage provide is that the preferred configuration (placing signal loss between the fourth and fifth coil wrapping/magnetic pole piece pair) results in a reduction of "noise" due to the noise cancelling configuration of forth coil wrapping/magnetic pole piece pair and the sixth coil wrapping/magnetic pole piece pair relative to each other. It is predicted that the noise canceling will be of the order of two-thirds.

Adjacent coils may also be configured with a partial semicircular cross-section (as in the edge coil wrappings described in FIG. 2), but with the semicircular faces adjacent one another. Preferably, fourth coil wrapping and the fifth coil wrapping would utilize this configuration. This preferred configuration concentrates pickup strength close to the magnetic pole piece and away from the region of magnetic field cancellation in the region of opposing fields between the pole pieces.

Figure 10:
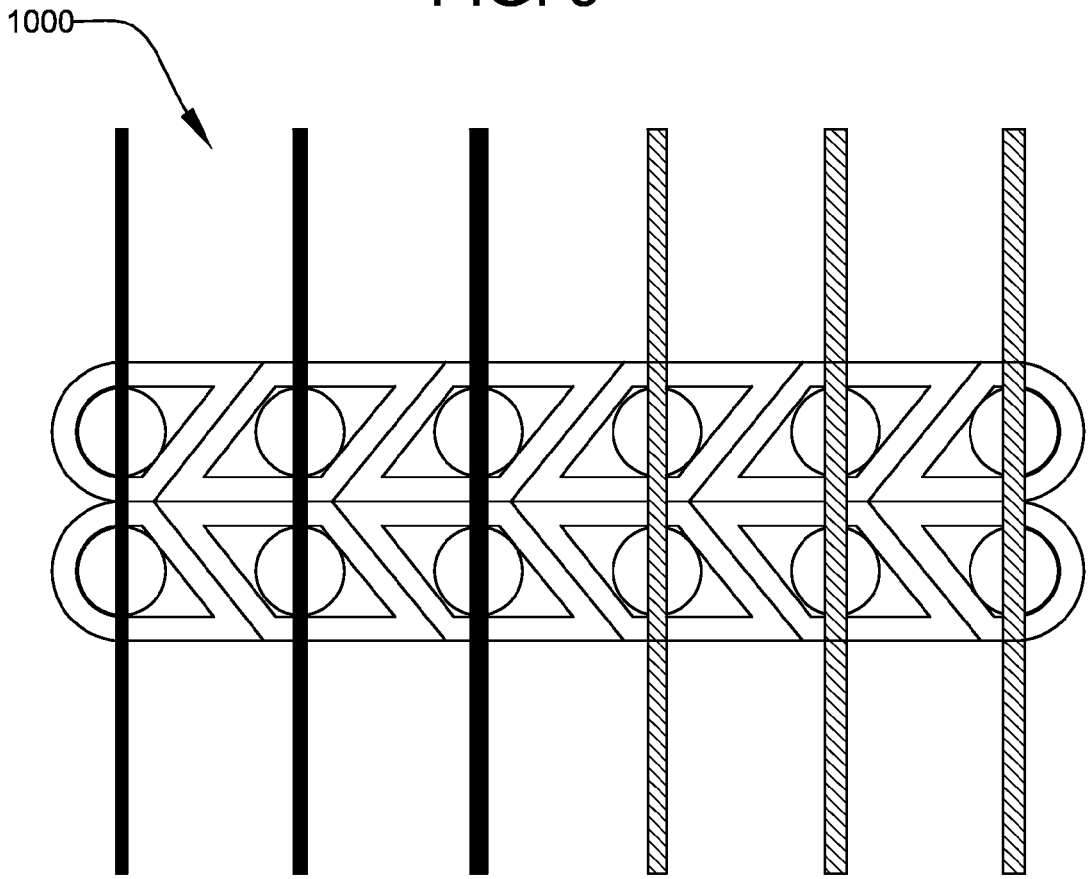
FIG. 10 shows a "humbucking" configuration of the musical instrument pickup according to a preferred embodiment of the present invention.

FIG. 10 shows a "humbucking" configuration of the musical instrument pickup according to a preferred embodiment of the present invention. Humbucking musical instrument pickup 1000 in FIG. 10 illustrates a guitar pickup having two rows of 6 coil wrappings/magnetic pole piece pairs. Humbucking musical instrument pickup 1000 illustrated in FIG. 10 is preferably configured with a RWRP configuration with respect to each other row. In this preferred embodiment, the coil-wire wrapping does not need to be wound in opposite directions in a RWRP configuration, but simply connected in reverse.

Figure 11:
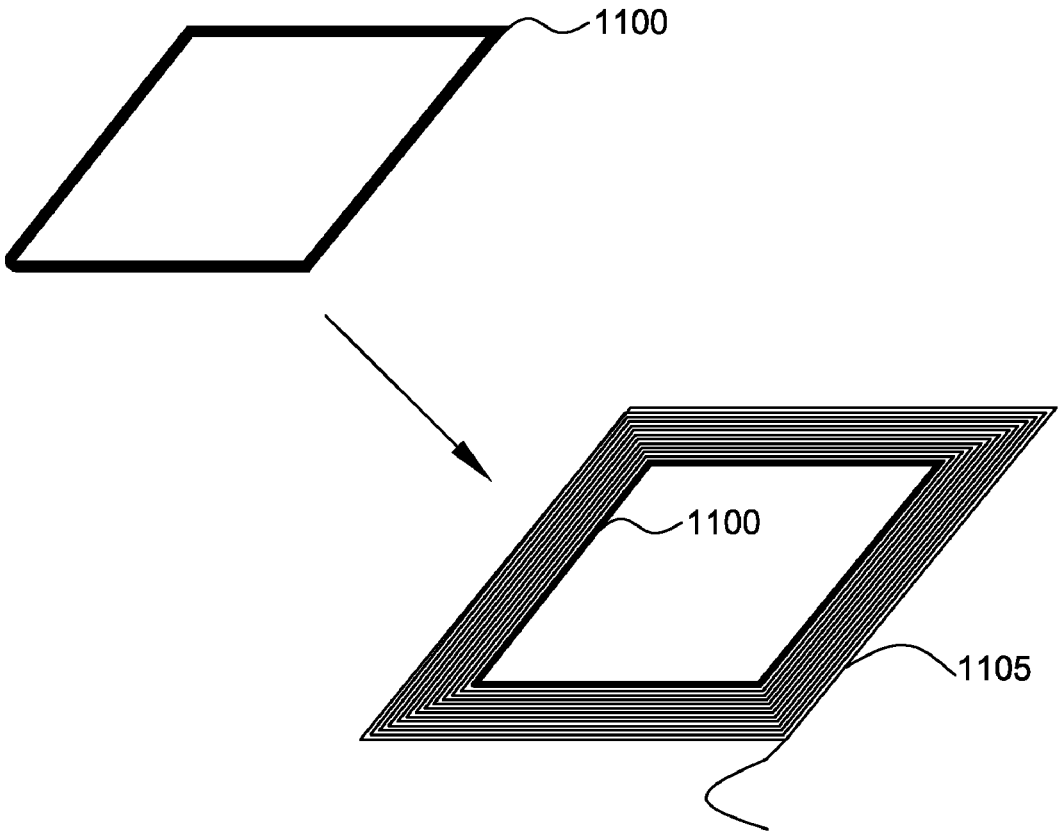
FIG. 11 shows a schematic view illustrating a supportive template around which coil wire is wrapped according to a preferred embodiment of the present invention.

FIG. 11 shows a schematic view illustrating a supportive template around which coil wire is wrapped according to a preferred embodiment of the present invention. Coil wire 1105 may preferably be wound to form the preferred geometric-shaped cross section with the assistance of supportive template 1100. As shown in FIG. 11, supportive template 1100 comprising a geometric cross-section. A preferred geometric cross-section of supportive template 1100 is a rhombus, as shown. Preferably, at least two of supportive template 1100 with wrapped coil-wire 1105 may be structured and arranged to fit together in an interlocking fashion (see FIG. 7). As in FIG. 3, when at least two of supportive template 1100 are arranged in an interlocking fashion, and when each supportive template 1100 is wrapped with coil wire 1105, the resulting configuration exhibits at least one coil-wire overlap between adjacent supportive templates 1100.

As the supportive template occupies some space, this consumes some available space for coil-wire wrapping between magnetic pole pieces. This space occupation make use of supportive template 1100 less preferred as it limits the allowable coil wall thickness of the coil wrapping. Manufacturing a self-supporting coil-wire wrapping is more preferred. Self supporting coils of this type may be fabricated by a number of suppliers, among them Dia-netics of 9510 Owensmouth Ave. #5, Chatsworth, Calif. 91311.

Figure 12:
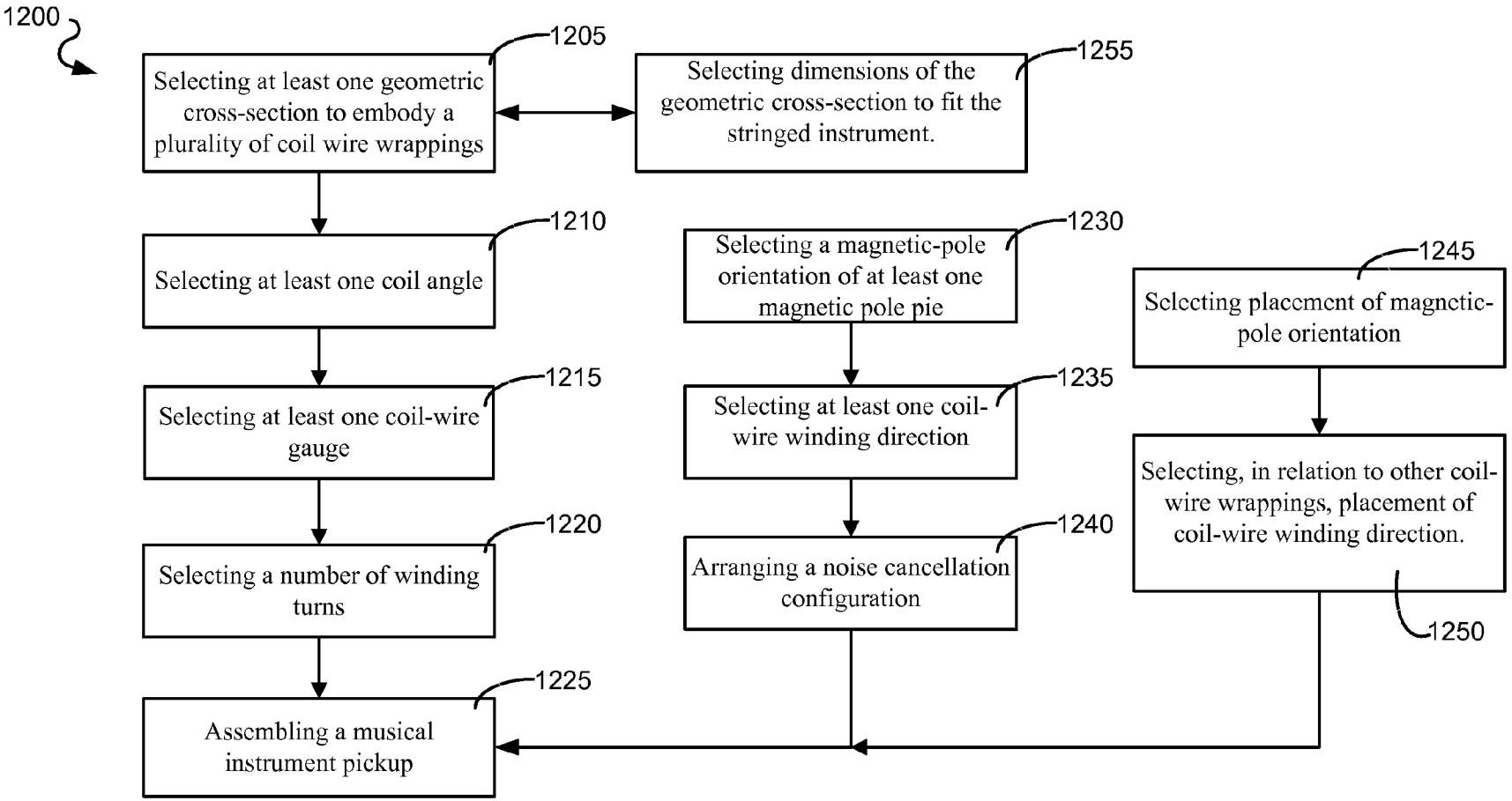
FIG. 12 shows a flowchart illustrating steps relating to a method of constructing a musical instrument pickup according to a preferred method of the present invention.

FIG. 12 shows a flowchart illustrating steps relating to a method of constructing a musical instrument pickup, method 1200, according to a preferred method of the present invention. Method 1200 comprises a number of steps that, when performed, result in constructing a musical instrument pickup with a user-desired signal output level and a user-desired tonal characteristic from a stringed instrument. Preferably, in first step 1205, one preferably selects at least one geometric cross-section to embody a plurality of independent coil-wire wrappings wherein each independent coil-wire wrapping of such plurality will be arranged together in an interlocking fashion. A preferred geometric cross section is a rhombus (see FIG. 3). An alternately preferred geometric cross section is an oval (see FIG. 8). In preferred step 1210, one preferably selects a coil angle (see discussion of coil angle above), as shown. The selected coil angle has a preferred value range from about 59 degrees to about 39 degrees. Preferably, the selected coil angle has a preferred value range less than 50 degrees. A preferred coil angle value discussed above is about 39 degrees. In preferred step 1215, one preferably selects at least one coil-wire gauge for each independent coil-wire wrapping. A preferred range of values for a selected coil-wire gauge ranges from about 45 to about 42. In preferred step 1220, one selects a number of winding turns of such selected coil-wire gauge to for each independent coil-wire wrapping, as shown. A preferred value for the selected winding turns has a range from 5500 to 8000. A factor in selecting the number of selected winding turns will be the selected coil-wire gauge. In preferred step 1225, one assembles the musical instrument pickup, for use with the stringed instrument, using the selections made in the above described steps. It should be noted that, in some instances, when the independent coil-wire wrappings having the selected geometric cross-section are interlocked, adjacent coil-wire wrappings exhibit at least one coil-wire overlap (see discussion of coil-wire overlap in relation to FIG. 3). Preferably, the assembled musical instrument pickup exhibits coil-wire overlaps. Alternately preferably, if the intent is not to exhibit a coil-wire overlap, the following steps may be performed to provide a custom designed, noise-cancellation pickup embodiment (such as is shown in FIG. 9). Still preferably, the following steps may be performed with a musical instrument pickup having coil-wire overlap.

In preferred step 1230, preferably, one selects a magnetic-pole orientation of magnetic pole piece to place in pickup flatwork. Either a "north" orientation or a "south" orientation is selected. In preferred step 1235, one preferably selects at least one winding direction for the coil-wire. Either a clockwise direction or a counterclockwise direction is selected for the winding direction. In preferred step 1240, the selected magnetic pole orientation and the selected winding direction are used to construct a "noise-cancelling" pickup configuration. A preferred configuration is shown in FIG. 9 where a "north" pole orientation is selected for string 1 to string 4 in a six string guitar, a "south" pole orientation is selected for string 5 and string 6 (preferred step 1245), a clockwise winding direction is selected for string 1 to string 4, and a counterclockwise direction is selected for string 5 and string 6 (preferred step 1250). It is noted that, using the above method, a plurality of noise-cancelling configurations are possible. Essentially, one selects placement of a selected magnetic pole orientation beneath a selected string in preferred step 1245, and one selects placement of a selected coil-wire wrapping winding direction in relation to other coil-wire wrappings in preferred step 1250, as shown.

In preferred step 1255, one selects dimensions of such selected geometric cross-section (selected in step 1205) to fit the stringed instrument. As an illustration, dimensions of geometric cross-section are chosen to retrofit an existing guitar and its space limitations with respect to guitar electronics and pickups.

Although applicant has described applicant's preferred embodiments of this invention, it will be understood that the broadest scope of this invention includes modifications such as diverse shapes, sizes, other musical instrument pickup construction techniques, and materials. Such scope is limited only by the below claims as read in connection with the above specification. Further, many other advantages of applicant's invention will be apparent to those skilled in the art from the above descriptions and the below claims.

What is claimed is:

1. A musical instrument pickup, relating to a stringed instrument having at least one string, the at least one string having a longitudinal axis, comprising:

a) a plurality of independent coil-wire wrappings, each having a geometric cross-section, able to be arranged together in an interlocking fashion;

b) a plurality of pole pieces, each having a center and a longitudinal axis orthogonal to the longitudinal axis of each string;

c) wherein the center of each pole piece of said plurality of pole pieces is arranged along a line having a constant angle with respect to the longitudinal axis of the at least one string;

d) wherein at least one coil-wire wrapping of said plurality of coil-wire wrappings surrounds at least one pole piece of said plurality of pole pieces, wherein the wrapping direction of coil wire of said at least one coil-wire wrapping is substantially orthogonal to the longitudinal axis of the pole pieces; and e) wherein, when said plurality of coil-wire wrappings are arranged in an interlocking fashion, i) a first plane, passing through a mid-point between adjacent pole pieces, such first plane being parallel to the longitudinal axis of the pole pieces and perpendicular to such line having a constant angle with respect to the longitudinal axis of the at least one string, intersects each coil-wire wrapping of adjacent coil-wire wrappings; and ii) a second plane, passing through the longitudinal axis of a pole piece, such second plane being perpendicular to such line having a constant angle with respect to the longitudinal axis of the at least one string, intersects only one coil wire wrapping.

2. The musical instrument pickup according to claim 1, wherein said a geometric cross-section is a rhombic cross section.

3. The musical instrument pickup according to claim 2, wherein each coil-wire wrapping forms a coil angle, said coil angle defined as the acute angle of said rhombic cross-section.

4. The musical instrument pickup according to claim 3, wherein said coil angle comprises a value between about 39 degrees and about 59 degrees.

5. The musical instrument pickup according to claim 3, wherein said coil angle comprises a value of less than about 50 degrees.

6. The musical instrument pickup according to claim 3, wherein said coil angle comprises a value of about 39 degrees.

7. The musical instrument pickup according to claim 1, wherein:

a) said plurality of independent coil-wire wrappings comprises i) a plurality of independent coil-wire wrappings wherein said geometric cross-section is a rhombic cross section, and ii) at least two independent coil-wire wrappings wherein said geometric cross-section comprises about one-half of one rhombus completed by an approximate semicircle;

b) wherein said plurality of independent coil-wire wrappings having a rhombic cross-section are end-capped by said at least two independent coil-wire wrappings having such geometric cross-section which comprises about one-half of one rhombus completed by an approximate semicircle.

8. The musical instrument pickup according to claim 1, wherein at least one coil-wire wrapping of said plurality of independent coil-wire wrappings comprises at least one supportive template around which coil wire is wrapped.

9. The musical instrument pickup according to claim 8, wherein said at least one supportive template comprises a rhombic cross-section.

10. The musical instrument pickup according to claim 8, wherein said at least one supportive template comprises an oval cross section.

11. The musical instrument pickup according to claim 1, wherein at least one pole piece, of said plurality of pole pieces, comprises a rhombic cross-section.

12. The musical instrument pickup according to claim 1, wherein at least one pole piece, of said plurality of pole pieces, comprises an oval cross-section.

13. The musical instrument pickup according to claim 1, wherein said coil wire comprises a coil-wire gauge between about 45 gauge and about 42 gauge.

14. The musical instrument pickup according to claim 1, wherein at least one of said plurality of pole pieces is a permanent magnet.

15. The musical instrument pickup according to claim 1 wherein:

e) at least two independent coil-wire wrappings of said plurality of coil-wire wrappings comprise a coil-wire winding direction;

f) at least two magnetic pole pieces of said plurality of pole pieces comprises a magnetic pole orientation;

g) to achieve noise cancellation, said at least two independent coil-wire wrappings comprise opposite effective coil-wire winding directions and said at least two magnetic pole pieces comprise opposite magnetic pole orientations.

16. The musical instrument pickup according to claim 1, wherein said geometric cross-section is a polygonal cross section.

17. The musical instrument pickup according to claim 1, wherein each of said plurality of independent coil-wire wrappings is self-supporting.

18. A method of constructing a musical instrument pickup, relating to achieving a user-desired signal output level and a user-desired tonal characteristic from a stringed instrument having at least one string having a longitudinal axis, comprising the steps of:

a) selecting at least one geometric cross-section to embody a plurality of independent coil-wire wrappings, each independent coil-wire wrapping of such plurality able to be arranged together in an interlocking fashion, and further, such independent coil-wire wrappings being structured and arranged to surround at least one magnetic pole piece having a center and a longitudinal axis orthogonal to the longitudinal axis of the at least one string;

b) wherein the step of selecting said at least one geometric cross-section comprises the step of selecting at least one coil angle, the coil angle defined by the angle formed by a longitudinally extending line oriented skew with respect to the longitudinal axis of the at least one string;

c) selecting at least one coil-wire gauge for each independent coil-wire wrapping;

d) selecting a number of winding turns of such selected coil-wire gauge for each independent coil-wire wrapping; and e) assembling, for use with the stringed instrument, a plurality of independent coil-wire wrappings having such selected geometric cross-section, such selected coil angle, such selected coil-wire gauge, and such selected number of winding turns such that, when such plurality of independent coil-wire wrappings are assembled in such interlocking fashion, and when the centers of each magnetic pole piece are arranged along a line having a constant angle with respect to the longitudinal axis of the at least one string, the musical instrument pickup is defined by i) a first plane, passing through a mid-point between adjacent magnetic pole pieces, such first plane being parallel to the longitudinal axis of the magnetic pole pieces and perpendicular to such line having a constant angle with respect to the longitudinal axis of the at least one string, which intersects each coil-wire winding of adjacent coil-wire wrappings; and ii) a second plane, passing through the longitudinal axis of a magnetic pole piece, such second plane being perpendicular to such line having a constant angle with respect to the longitudinal axis of the at least one string, which intersects only one coil wire wrapping.

19. The method according to claim 18, further comprising the step(s) of:

a) selecting a magnetic-pole orientation of the at least one magnetic pole piece;

b) selecting at least one effective winding direction for each independent coil-wire wrapping;

c) arranging, for noise cancellation purpose, such selected magnetic-pole orientation and such selected effective winding direction.

20. The method according to claim 19, wherein the step of arranging such selected magnetic pole piece pole orientation comprises the step(s) of:

a) selecting, for each string of the stringed instrument, placement, in relation to a string of the stringed instrument, of at least one coil-wire wrapping having such selected magnetic-pole orientation;

b) selecting, in relation to other coil-wire wrappings, placement of at least one coil-wire wrapping having such selected effective winding direction.

21. The method according to claim 18, further comprising the step(s) of selecting dimensions of such selected geometric cross-section to fit the stringed instrument.

22. A pickup for a six string electric guitar comprising:

a) an electric guitar having six strings of varying gauges arranged from largest gauge to smallest gauge;

b) a pickup assembly for said electric guitar comprising i) six independent coil-wire assemblies, each having a geometric cross-section, able to be arranged together in an interlocking fashion, ii) six pole pieces each having a magnetic pole orientation, a center, and a longitudinal axis orthogonal to the longitudinal axis of the string, iii) wherein the centers of said six pole pieces are arranged along a line having a constant angle with respect to the longitudinal axis of at least one of the six strings, iv) wherein each independent coil-wire assembly surrounds one pole piece, v) wherein, when said six independent coil-wire assemblies are arranged in an interlocking fashion, (1) a first plane, passing through a mid-point between adjacent pole pieces, such first plane being parallel to the longitudinal axis of the pole pieces and perpendicular to such line having a constant angle with respect to the longitudinal axis of the at least one string, intersects each coil-wire winding of adjacent coil-wire wrappings; and (2) a second plane, passing through the longitudinal axis of a pole piece, such second plane being perpendicular to such line having a constant angle with respect to the longitudinal axis of the at least one string, intersects only one coil wire wrapping;

vi) wherein two of said coil-wire assemblies comprise (1) coil wire wound in a first effective winding direction, and (2) a first magnetic pole orientation, and vii) wherein four of said coil wire assemblies comprise (1) coil wire wound in a second effective winding direction being opposite of said first effective winding direction, and (2) a second magnetic pole orientation;

viii) wherein two of said coil-wire assemblies of the first wiring direction are positioned beneath the two strings of the largest gauge.

* * * * *